United States Patent [19]

Cordes

[11] 4,323,129

[45] Apr. 6, 1982

[54] HOLE DIGGING APPARATUS AND METHOD

[76] Inventor: William J. Cordes, 330 F St., Bakersfield, Calif. 93304

[21] Appl. No.: 124,537

[22] Filed: Feb. 25, 1980

[51] Int. Cl.[3] ..... E21B 10/32

[52] U.S. Cl. ..... 175/285; 175/173

[58] Field of Search ..... 175/284, 285, 57, 263, 175/173; 405/237, 238

[56] References Cited

U.S. PATENT DOCUMENTS

| | | | |
|---|---|---|---|
| 964,680 | 11/1908 | Burrows | 175/285 |
| 1,970,063 | 8/1934 | Steinman | 175/285 |
| 2,836,396 | 5/1958 | Rawlinson, Sr. | 175/285 |
| 3,336,989 | 8/1967 | Henderson | 175/285 |
| 3,379,266 | 4/1968 | Fletcher | 175/285 |

FOREIGN PATENT DOCUMENTS

| | | | |
|---|---|---|---|
| 1455777 | 11/1976 | United Kingdom | 175/285 |

*Primary Examiner*—William F. Pate, III

*Attorney, Agent, or Firm*—Naylor, Neal & Uilkema

[57] ABSTRACT

Cables attached to a rotating Kelly nut of a drill rig serve to maintain the vertical level of pivot points of bell-cutting blades while the blades are swung outwardly about these stationary pivot points to cut a bell for a drilled hole. The bell cuttings gravitate to the bottom of the drilled hole which is disposed a predetermined distance below the location of the bell.

5 Claims, 4 Drawing Figures

HOLE DIGGING APPARATUS AND METHOD

BACKGROUND OF THE INVENTION

It is common practice in the installation of concrete earth anchors, or deadmen, to drill holes with augers and to bell the holes at the bottom with a belling bucket. The belling time per hole has been 45–60 minutes. When the belling is done with the use of the procedure and apparatus of the present inventions, the belling time per hole is reduced to 3–5 minutes. This reduction in time is due to the fact that it is not necessary to remove the bell cuttings from the hole and to the fact that the belling tool does not load up during the belling operation.

SUMMARY OF THE INVENTION

The principal object of the invention is to make it possible to bell a ground anchor hole in a small fraction of the time required to do so under conventional belling practice.

This object is accomplished by limiting the downward movement of the belling bucket within the hole by means of holding cables interconnecting the bucket and the Kelly nut. These cables halt the downward movement of the bucket at a predetermined level above the bottom of the hole. Subsequent downward movement of the Kelly bar causes the cutting blades of the belling bucket to bell the hole. The belling bucket is modified to be open at the bottom so that the bell cuttings drop into and fill the lower end of the hole.

In a modified form of the apparatus of the invention, bell-cutting blades are attached to an auger. Once the hole has been drilled the auger is backed off from the bottom of the hole and holding cables are connected between the Kelly nut and the bell-cutting blades. Subsequent downward movement of the Kelly bar in the hole causes the blades to cut the bell and causes the bell cuttings to be deposited in the bottom of the hole.

DESCRIPTION OF THE PREFERRED EMBODIMENTS

Pivotally mounted and self-powered drill heads are put on truck tractors for ready transport and use in the digging of ground anchor holes. Such equipment comprises Kelly bar 10, Kelly nut 12 and Kelly bar drive 14. Drive 14 operates to raise and lower the Kelly bar 10 and to rotate Kelly nut 12 to impart rotational movement to the bar 10.

The ground anchor hole 16, which is about 12 feet deep on the average, has been formed with an auger, not shown, which was attached to Kelly bar 10. Following the digging of hole 16, the bar 10 was raised and the auger was replaced with the belling apparatus shown in FIGS. 1 and 2.

Figure 1:
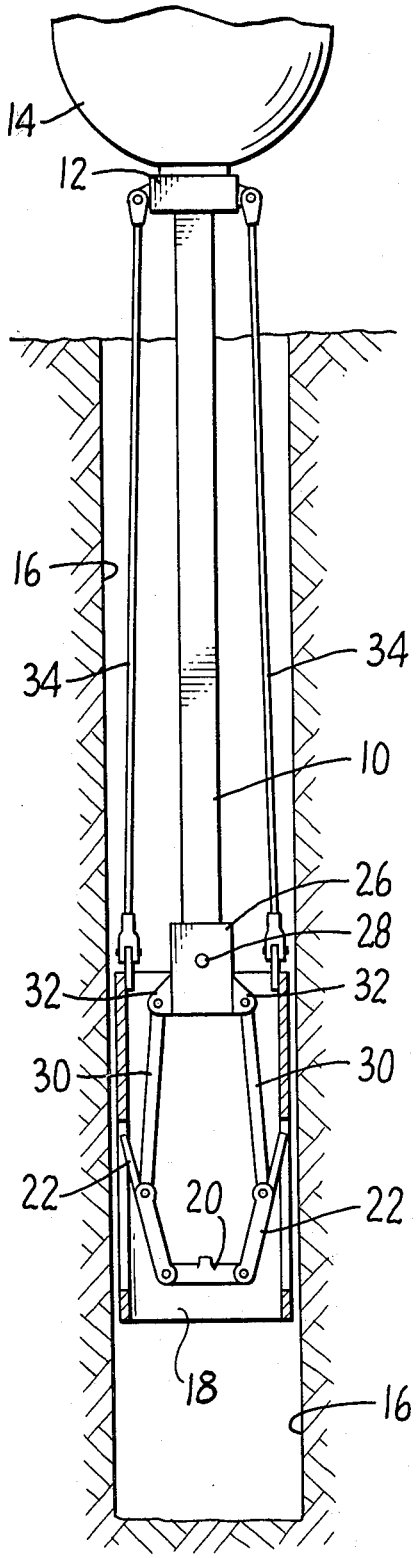
FIG. 1 is a view partly in section and partly in elevation showing one embodiment of the apparatus of the invention positioned within a drilled hole for the bell-cutting operation.
Figure 2:
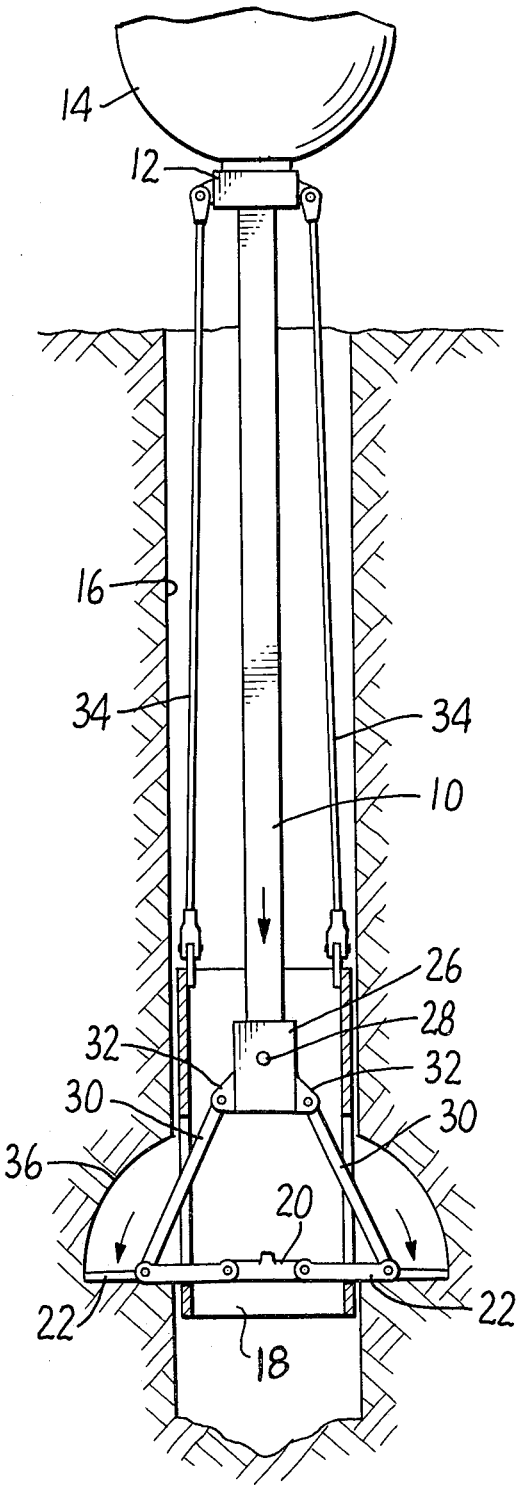
FIG. 2 is a view similar to FIG. 1 showing the apparatus at the end of the bell-cutting operation.

The belling apparatus of FIGS. 1 and 2 comprises a cylindrical bucket or shell 18 open at both ends, link member 20 fixedly attached to bucket 18, cutting blades 22 pivotally connected to link 20 and projectable through slots 24 in the bucket 18, collar 26 removably attached to Kelly bar 10 as by pin 28, links 30 pivotally connected to blades 22 and to ears 32 on collar 26, and a pair of cables 34 interconnecting Kelly nut 12 and bucket 18. The cables 34 suspend the bucket 18 a predetermined distance above the bottom of hole 16.

Belling is accomplished by moving Kelly bar 10 downwardly from its FIG. 1 position to the position shown in FIG. 2 while bar 10 is driven in rotation by nut 12. The cables 34 maintain the bucket 18 and link 20 at the same vertical level as the Kelly bar is moved downwardly to progressively pivot the blades 22 from their FIG. 1 to their FIG. 2 position, thereby cutting the bell 36. The cuttings pass through slots 24 and through the open bottom end of bucket 18 to the lower end of hole 16.

After the belling operation, the Kelly bar is raised to its FIG. 1 position and thereafter the apparatus is withdrawn from hole 16.

Figure 3:
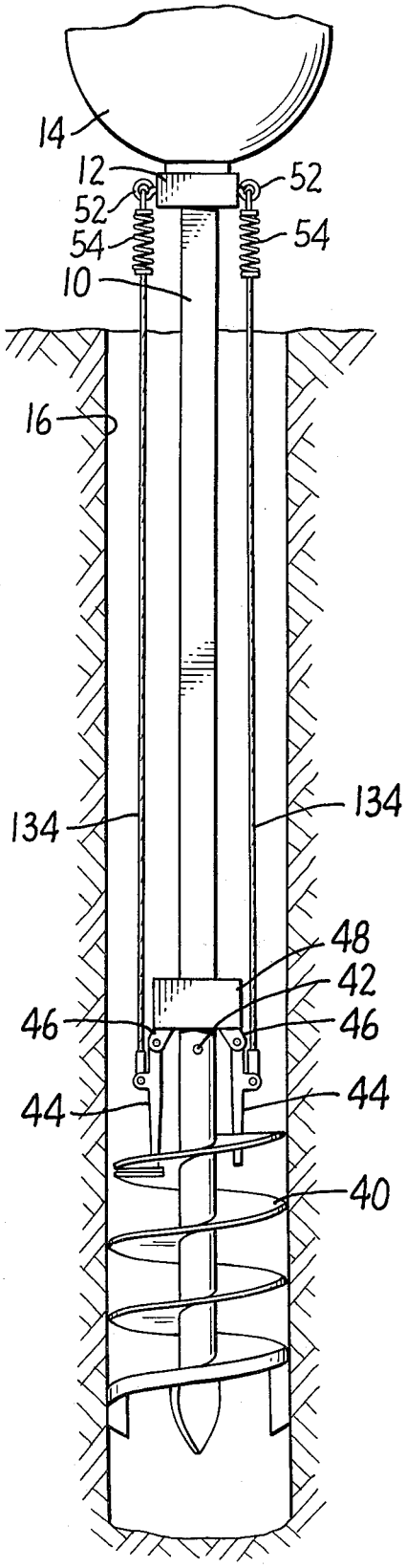
FIG. 3 is a view similar to FIG. 1 of a further embodiment of the apparatus of the invention.
Figure 4:
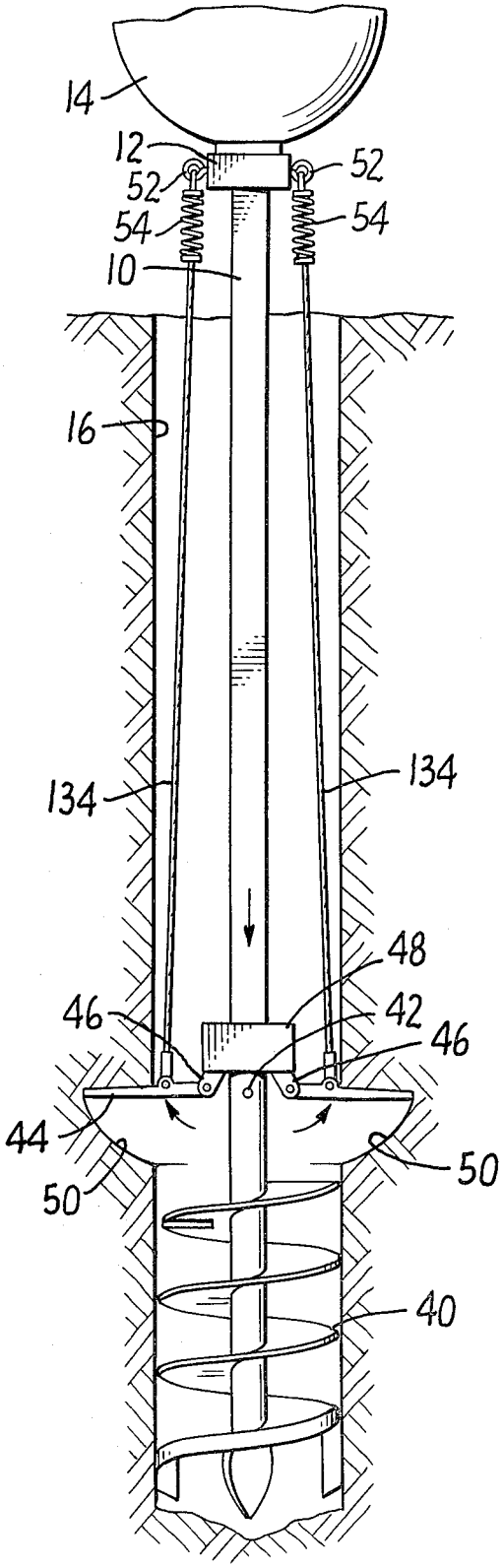
FIG. 4 is a view similar to that of FIG. 3 but showing the apparatus at the end of the bell-cutting operation.

In the embodiment of FIGS. 3 and 4 the drill auger 40 which was used to dig hole 16 is shown attached to Kelly bar 10 as by pin 42. Cutting blades 44 having pivotal connections 46 with auger collar 48 are provided for the belling operation. For the belling operation the cables 134 are provided in interconnecting relation with the cutting blades and Kelly nut 12. The cables 134 and blades 44 were not in place during the drilling of hole 16 with auger 40. Thereafter cables and blades are attached to the auger and the apparatus is put back in the hole 16 to the depth shown in FIG. 3. Subsequent rotative movement and downward movement of Kelly bar 10 causes the blades 44 to be swung from their FIG. 3 position to their FIG. 4 position to cut the bell 50. During this belling operation the cuttings pass downwardly along the auger into the cutting receptacle constituted by the bottom of hole 16.

The FIGS. 3–4 embodiment may be modified to cut a bell of the shape of FIG. 2 by connecting the cables to a ring carrying the pivotal connections 46 and connecting the collar 48 to the middle parts of the undersides of the blades through thrust links. Thus, as the Kelly bar is moved down the blades would be thrust outwardly about the stationary pivotal connections 46.

It is desirable to provide in all embodiments swivel hook connectors 52 between the upper ends of the cables and the Kelly nut 12 and to provide right below the swivel hooks a helical spring 54 in each cable constituting a flexible, stretchable part of the cable. The operator of the drill rig may then control the power applied to the Kelly bar in a way to avoid undue stretching of the springs. This enables the operator to so operate the rig as to minimize the breakage of parts. For example, undue stretching of the springs would indicate that the blades are about to become hung-up by taking too big a "bite" for the ground being worked. The operator would then reduce the "bite" accordingly.

What is claimed is:

1. Apparatus for belling a drill hole comprising in combination with a Kelly bar, Kelly nut and drive means therefor a pair of pivotally mounted bell-cutting blades, first means including cable means interconnecting said Kelly nut and first pivotal axes of said blades operable to maintain the level of said axes a fixed distance above the bottom of the drill hole while said blades are rotated about said fixed level axes as centers of rotation into and out of bell-cutting positions, and second means comprising said Kelly bar connected to second pivotal axes of said blades and operable to vertically move the same to effect movement of said blades into and out of bell-cutting positions.

2. Apparatus for belling a drill hole comprising a belling bucket modified to be open at both ends, said bucket having a pair of belling blades fixedly but pivotally connected to the bucket for movement inwardly and outwardly thereof through slots provided in the side wall of said bucket, a collar adapted to be removably attached to a Kelly bar, a pair of links having their upper ends pivotally attached to said collar and their lower ends pivotally connected to said blades at intermediate points along said blades, and a pair of opposed eye members attached to the upper end of said bucket to enable the connection of a pair of suspension cables to said bucket.

3. Apparatus for belling a drill hole comprising in combination with a Kelly bar, Kelly nut and drive means therefor a pair of pivotally mounted bell-cutting blades, first means including cable means interconnecting said Kelly nut and first pivotal axes of said blades operable to maintain the level of said axes fixed while said blades are pivotally moved thereabouts into and out of bell-cutting positions, second means comprising said Kelly bar connected to second pivotal axes of said blades and operable to move the same to effect movement of said blades into and out of bell-cutting positions, swivel hook means interconnecting said cables and Kelly nut, and spring means embodied in said cables adjacent said swivel hook means.

4. Apparatus for belling a drill hole comprising in combination with a Kelly bar, Kelly nut and drive means therefor a pair of pivotally mounted bell-cutting blades, first means including cable means interconnecting said Kelly nut and first pivotal axes of said blades operable to maintain the level of said axes fixed while said blades are pivotally moved thereabouts into and out of bell-cutting positions, and second means comprising said Kelly bar connected to second pivotal axes of said blades and operable to vertically move the same to effect movement of said blades into and out of bell-cutting positions, said first means further comprising a belling bucket modified to be open at both ends, said blades being pivotally connected thereto about said first axes, said cable means interconnecting said Kelly nut and the upper end of said bucket, said second means further comprising links having their upper ends pivotally connected to a collar which is removably attached to said Kelly bar and having their lower ends pivotally attached to said blades at said second pivotal axes.

5. Apparatus for belling a drill hole comprising in combination with a Kelly bar, Kelly nut and drive means therefor a pair of pivotally mounted bell-cutting blades, first means including cable means interconnecting said Kelly nut and first pivotal axes of said blades operable to maintain the level of said axes fixed while said blades are pivotally moved thereabouts into and out of bell-cutting positions, and second means comprising said Kelly bar connected to second pivotal axes of said blades and operable to vertically move the same to effect movement of said blades into and out of bell-cutting positions, said first pivotal axes comprising the connections between said cable means and said blades, said connections being located between the ends of said blades, said second means further comprising an auger removably attached to said Kelly bar, said blades having their inner ends connected to the upper end of said auger about said pivotal axes.

* * * * *